US009102135B2

(12) United States Patent
Minoshima et al.

(10) Patent No.: US 9,102,135 B2
(45) Date of Patent: Aug. 11, 2015

(54) PLATE ATTACHMENT DEVICE AND METHOD FOR ATTACHING/DETACHING PRINTING PLATE

(75) Inventors: Kenichi Minoshima, Shinagawa-ku (JP); Hitoshi Tojima, Shinagawa-ku (JP); Shingo Hashimoto, Shinagawa-ku (JP); Masayuki Saitou, Shinagawa-ku (JP)

(73) Assignee: Showa Aluminum Can Corporation, Tokyo (JP)

( * ) Notice: Subject to any disclaimer, the term of this patent is extended or adjusted under 35 U.S.C. 154(b) by 68 days.

(21) Appl. No.: 13/877,680

(22) PCT Filed: Sep. 29, 2011

(86) PCT No.: PCT/JP2011/072364

§ 371 (c)(1), (2), (4) Date: Jun. 6, 2013

(87) PCT Pub. No.: WO2012/046618

PCT Pub. Date: Apr. 12, 2012

(65) Prior Publication Data

US 2013/0263750 A1 Oct. 10, 2013

(30) Foreign Application Priority Data

Oct. 6, 2010 (JP) ..... 2010-226918

(51) Int. Cl.

| | |
|---|---|
| ***B41F 27/12*** | (2006.01) |
| ***B41F 27/06*** | (2006.01) |
| ***B41F 13/10*** | (2006.01) |
| *B41F 27/10* | (2006.01) |

(52) U.S. Cl.

CPC ..... *B41F 27/06* (2013.01); *B41F 13/10* (2013.01); *B41F 27/1218* (2013.01); *B41F 27/1281* (2013.01); *B41F 27/105* (2013.01); *B41F 27/1237* (2013.01); *B41P 2227/42* (2013.01)

(58) Field of Classification Search

CPC ..... B41F 27/06
USPC ..... 101/383
See application file for complete search history.

(56) References Cited

U.S. PATENT DOCUMENTS 758,486 A * 4/1904 Such ..... 101/375
1,674,635 A * 6/1928 Burden ..... 101/375

(Continued)

FOREIGN PATENT DOCUMENTS

GB 1 476 707 A 6/1977
JP 51-24309 A 2/1976

(Continued)

OTHER PUBLICATIONS

Official Communication issued in International Patent Application No. PCT/JP2011/072364, mailed on Nov. 1, 2011.

*Primary Examiner* — Jill Culler
(74) *Attorney, Agent, or Firm* — Keating & Bennett, LLP

(57) ABSTRACT

A plate attachment device and a method for attaching and removing printing plates, wherein the positioning accuracy in the circumferential direction relative to a plate cylinder is increased and attachment and removal of the printing plate is easy, are provided. The plate attachment device 1 is equipped with a plate cylinder 11 secured to the outer periphery of a plate drive shaft 31 and having a cylindrical plate attaching surface 12 to which a printing plate 2 is to be attached from the tip end side of the plate drive shaft 31. The plate attaching surface 12 is provided with a plurality of plate securing members 121 which are formed to be movable to both the outer side and inner side in the radial direction of the plate cylinder 11, abut the printing plate 2 attached to the plate attaching surface 12 and expand in the radial direction so as to adhere and secure the printing plate 2 to the plate attaching surface 12.

11 Claims, 7 Drawing Sheets

(56) References Cited

U.S. PATENT DOCUMENTS

| | | | | | |
|---|---|---|---|---|---|
| 1,789,292 | A | * | 1/1931 | Banzett | 101/415.1 |
| 4,833,986 | A | * | 5/1989 | Kobler | 101/415.1 |
| 4,917,013 | A | * | 4/1990 | Katz | 101/375 |
| 5,117,755 | A | | 6/1992 | Fina | |
| 5,488,903 | A | * | 2/1996 | Kobler et al. | 101/375 |
| 2004/0244615 | A1 | | 12/2004 | Herbert et al. | |
| 2011/0120332 | A1 | | 5/2011 | Izume | |
| 2011/0210111 | A1 | | 9/2011 | Izume | |

FOREIGN PATENT DOCUMENTS

| | | | |
|---|---|---|---|
| JP | 56-093554 | A | 7/1981 |
| JP | 61-248746 | A | 11/1986 |
| JP | 03-024959 | A | 2/1991 |
| JP | 2005-504667 | A | 2/2005 |
| JP | 2006-272682 | A | 10/2006 |
| JP | 2010-012616 | A | 1/2010 |
| JP | 2010-042531 | A | 2/2010 |
| JP | 2011-025543 | A | 2/2011 |
| WO | 2010/018702 | A1 | 2/2010 |

* cited by examiner

PLATE ATTACHMENT DEVICE AND METHOD FOR ATTACHING/DETACHING PRINTING PLATE

TECHNICAL FIELD

The present invention relates to a plate attachment device for attaching a printing plate and a method for attaching/detaching a printing plate.

BACKGROUND TECHNIQUE

In recent years, as a plate attachment device for attaching a printing plate to a printing machine, a device is known in which a cylindrical printing plate is attached to an outer periphery of a plate cylinder to be fixed to a plate drive shaft.

In such a plate attachment device, it has been desired to improve the working efficiency and the positioning accuracy at the time of attaching the cylindrical printing plate.

Patent Document 1 listed below proposes a printing device facilitated in attaching and detaching a printing plate by ejecting air from a plate attachment device. Patent Document 2 listed below proposes a plate attachment device in which permanent magnets are arranged on an inside of an outer periphery of a cylinder portion so that a printing plate can be attached while absorbing the printing plate to an outer circumferential surface of the cylinder portion by a magnetic force.

Further, Patent Document 3 listed below proposes a plate attachment device having a plate securing member configured to push a non-printing portion of a printing plate radially outward from a radially inward side of the printing plate to closely fix the printing plate to a plate attaching surface of a plate cylinder.

PRIOR ART

Patent Document

Patent Document 1: Japanese Unexamined Laid-open Patent Application Publication No. 2006-272682

Patent Document 2: Japanese Unexamined Laid-open Patent Application Publication No. 2010-12616

Patent Document 3: Japanese Unexamined Laid-open Patent Application Publication No. 2010-42531

SUMMARY OF THE INVENTION

Problems to be Solved by the Invention

However, in cases where a diameter of a cylindrical printing plate is designed to be closer to a diameter of a plate cylinder, the plate cylinder and the printing plate are brought into close contact with each other, resulting in an improved positioning accuracy of the printing plate in the circumferential direction relative to the plate cylinder. There is, however, a tendency to cause difficulty in attaching and detaching the printing plate.

When making the diameter of the cylindrical printing plate larger than the diameter of the plate cylinder, the operability of attaching and detaching the printing plate can be improved. There is, however, a tendency to deteriorate the circumferential positional accuracy of the printing plate relative to the plate cylinder when attaching the printing plate to the plate cylinder.

In order to crease a gap between a printing plate and a plate cylinder, there was an attempt to decrease a circumference length of the plate cylinder by cutting out a part of the outer periphery of the plate cylinder into a flat surface. When cutting out more of a part of the outer periphery of the plate cylinder, the attaching and detaching operability can be improved. However, when cutting out a part of the plate cylinder corresponding to the printing surface of the printing plate, there is a problem that printing defects such as misalignment of images occur.

As discussed above, it was difficult to simultaneously improve both the circumferential positioning accuracy of the printing plate relative to the plate cylinder and the operability of attaching and detaching the printing plate.

Means for Solving the Problems

In view of the aforementioned technical background, the present invention aims to provide a plate attachment device capable of improving a circumferential positioning accuracy of a printing plate relative to a plate cylinder and easily attaching/detaching the printing plate from/to the plate cylinder, and also to provide a method for attaching/detaching a printing plate from/to the plate cylinder.

The present invention includes the structure as recited in the following Items [1] to [10].

[1] A plate attachment device to be fixed to a plate drive shaft of a printing machine for attaching a printing plate including a cylindrical plate main body and a printing portion formed on apart of an outer peripheral portion of the cylindrical plate main body, comprising:

a plate cylinder configured to be fixedly mounted on an outer periphery of the plate drive shaft and having a cylindrical plate attaching surface to which the printing plate is to be attached from a tip end side of the print drive shaft; and a plurality of plate securing members arranged at the plate attaching surface so as to be movable in both radially outward and inward directions of the plate cylinder and configured to come into contact with the printing plate attached to the plate attaching surface to increase a diameter of the printing plate to closely attach the printing plate to the plate attaching surface.

[2] The plate attachment device as recited in Item 1, wherein at least a part of the plate securing member includes a contact surface which comes into contact with an inner peripheral portion of the printing plate, the contact surface being formed to have a curved shape having a same curvature as an outer peripheral surface of the plate cylinder.

[3] The plate attachment device as recited in Item 2, wherein the contact surface of the plate securing member is configured to be positioned at a same height as the plate attaching surface of the plate cylinder when the printing plate is in close contact with the plate attaching surface.

[4] The plate attachment device as recited in any one of Items 1 to 3, wherein the plurality of plate securing members are arranged at symmetrical positions on a circumference of circle of the plate cylinder.

[5] The plate attachment device as recited in any one of Items 1 to 4, wherein the printing plate is provided with an engaging portion inwardly protruding from an inner periphery of the plate main body and extending in an axial direction of the plate main body, and wherein the plate cylinder is provided, at an outer peripheral surface thereof, with a circumferential positioning groove into which the engaging portion of the printing plate is fitted from the tip end side of the plate drive shaft.

[6] A method of attaching and detaching a printing plate having a printing portion provided at a part of an outer peripheral portion of a cylindrical plate main body to and from a plate attachment device fixed to a print drive shaft of a printing machine, comprising the steps of:

moving a plurality of plate securing members radially inward of a plate cylinder, wherein the plurality of plate securing members are each arranged movable in both radially outward and inward directions of the plate cylinder fixed to an outer periphery of the plate drive shaft and having a cylindrical plate attaching surface;

fitting the printing plate onto the plate cylinder from a tip end side of the plate drive shaft in a state in which a circumferential length of the outer periphery of the plate cylinder is set to be shorter than a circumferential length of the inner periphery of the printing plate;

mounting the printing plate onto the plate cylinder so that the plate attaching surface which is an outer periphery of the plate cylinder and an inner peripheral surface of the printing plate come into close contact with each other by moving the plate securing members radially outward of the plate cylinder;

making a gap between the plate cylinder and the printing plate by moving the plate securing members radially inward of the plate cylinder from a state in which the plate attaching surface which is an outer periphery of the plate cylinder and the inner peripheral surface of the printing plate are in close contact with each other; and detaching the printing plate from the plate cylinder by pulling out the printing plate fitted on the plate cylinder in a direction toward a tip end of the plate drive shaft.

[7] The printing plate attachment and detachment method as recited in Item 6, wherein at least a part of the plate securing member formed into a curved surface shape having a same curvature as an outer peripheral surface of the plate cylinder is brought into contact with an inner peripheral portion of the printing plate.

[8] The printing plate attachment and detachment method as recited in Item 7, wherein the surface of the plate securing member is positioned at the same height as the plate attaching surface of the plate cylinder when the printing plate is closely fixed to the plate attaching surface of the printing plate.

[9] The printing plate attachment and detachment method as recited in any one of Items 6 to 8, wherein the plurality of plate securing members are arranged at symmetrical positions on a circumference of circle of the plate cylinder.

[10] The printing plate attachment and detachment method as recited in any one of Items 6 to 9, wherein an engaging portion of the printing plate protruding inwardly from the inner periphery of the plate main body and extending in a radial direction of the plate main body is fitted into a circumferential positioning groove formed in the outer periphery of the plate cylinder from the tip end side of the plate drive shaft.

Effects of the Invention

According to the plate attachment device as recited in the aforementioned Item [1], the circumferential length of the outer circumference of the plate cylinder can be adjusted since a plurality of plate securing members are movable. With that structure, while the plate attaching surface and the printing plate are closely fixed to each other at the time of printing, an easy attachment and detachment of the printing plate can be performed by securing an enough space between the plate attaching surface and the printing plate at the time of attachment and detachment thereof. Further, each plate securing member can be reduced in size and weight and the burden of operation can be reduced at the time of moving the plate securing member.

According to the plate attachment device as recited in the aforementioned Item [2], the contact surface of at least apart of the plate securing member, which comes into contact with an inner peripheral portion of the printing plate, is formed to have a curved shape having a same curvature as an outer peripheral surface of the plate cylinder. Therefore, the likelihood of occurring deformation of the printing plate such as bending of the printing plate can be reduced even when the plate securing member is moved radially outward of the plate cylinder.

According to the plate attachment device as recited in the aforementioned Item [3], the contact surface of the plate securing member is configured to be positioned at a same height as the plate attaching surface of the plate cylinder, which hardly causes deformation of the printing plate and misalignment of printing image.

According to the plate attachment device as recited in the aforementioned Item [4], the plurality of plate securing members are arranged at symmetrical positions on a circumference of circle of the plate cylinder, and therefore the weight balance of the plate cylinder is excellent and the rotary motion at the time of printing is performed smoothly.

According to the plate attachment device as recited in the aforementioned Item [5], by fitting the engaging portion of the printing plate into the circumferential positioning groove provided in the plate cylinder, the positioning of the printing plate and the plate cylinder in the circumferential direction can be done easily.

According to the method of attaching/detaching a printing plate as recited in the aforementioned Item [6], the circumferential length of the outer periphery of the plate cylinder can be adjusted because a plurality of plate securing members are movable. Therefore, with that structure, while the plate attaching surface and the printing plate are closely fixed to each other at the time of printing, an easy attachment and detachment of the printing plate can be performed by securing an enough space between the plate attaching surface and the printing plate at the time of attachment and detachment thereof. Further, each plate securing member can be reduced in size and weight and the burden of operation can be reduced at the time of moving the plate securing member.

According to the method of attaching/detaching a printing plate as recited in the aforementioned Item [7], the contact surface of at least a part of the plate securing member, which comes into contact with an inner peripheral portion of the printing plate, is formed to have a curved shape having a same curvature as an outer peripheral surface of the plate cylinder. Therefore, the likelihood of occurring deformation of the printing plate such as bending of the printing plate can be reduced even when the plate securing member is moved radially outward of the plate cylinder.

According to the method attaching/detaching a printing plate as recited in the aforementioned Item [8], the surface of the plate securing member is positioned at the same height as the plate attaching surface of the plate cylinder, which causes no deformation of the printing plate and less likely causes misalignment of a printing image.

According to the method attaching/detaching a printing plate as recited in the aforementioned Item [9], the plurality of plate securing members are arranged at symmetrical positions on a circumference of circle of the plate cylinder, and therefore the weight balance of the plate cylinder is excellent and the rotary motion at the time of printing is performed smoothly.

According to the method attaching/detaching a printing plate as recited in the aforementioned Item [10], by fitting the engaging portion of the printing plate into the circumferential positioning groove provided in the plate cylinder, positioning of the printing plate and the plate cylinder in the circumferential direction can be performed easily.

EMBODIMENTS FOR CARRYING OUT THE INVENTION

Hereinafter, embodiments of the present invention will be explained with reference to the drawings.

Figure 1:
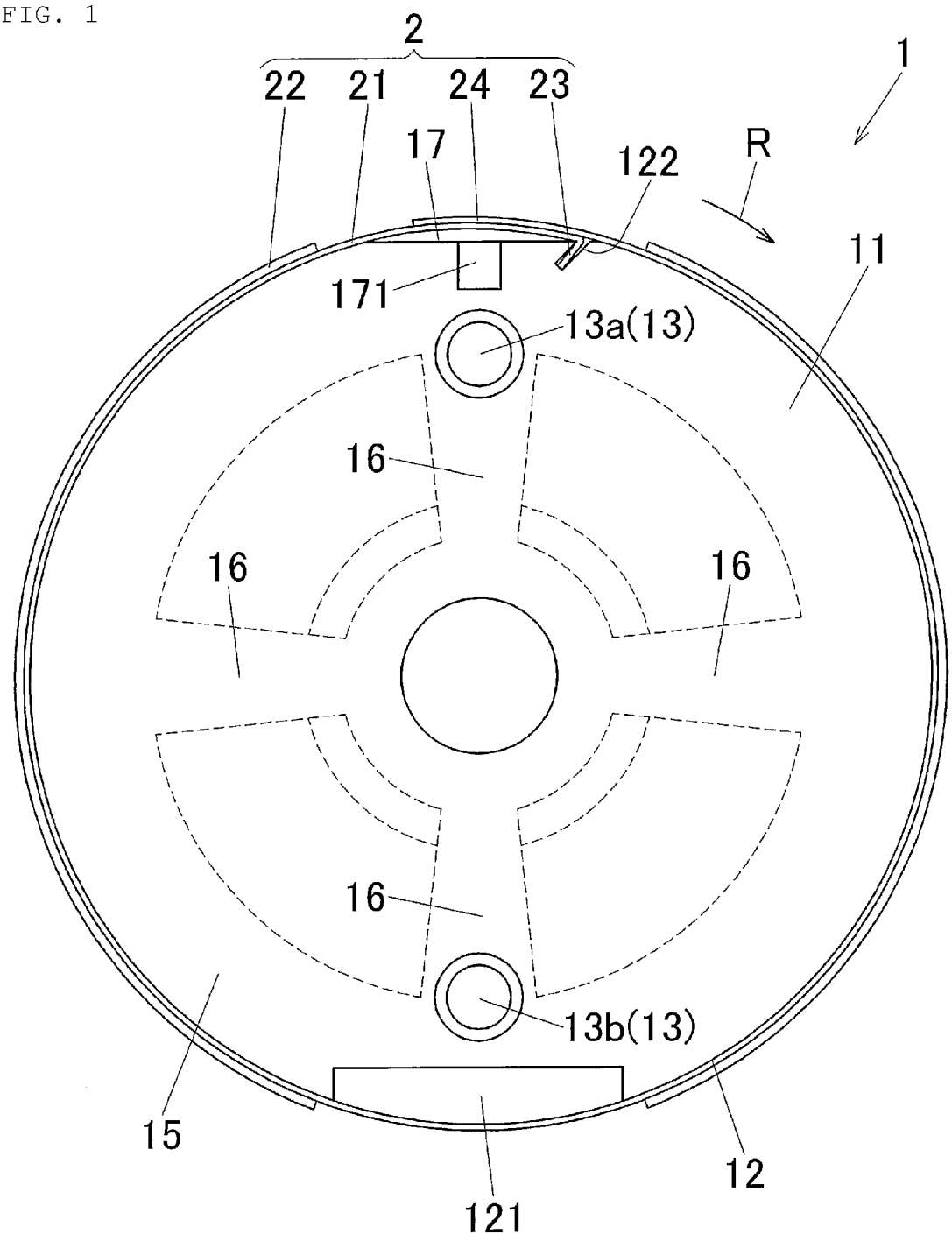
FIG. 1 is a front view of a plate attachment device according to one embodiment of the present invention.
Figure 2:
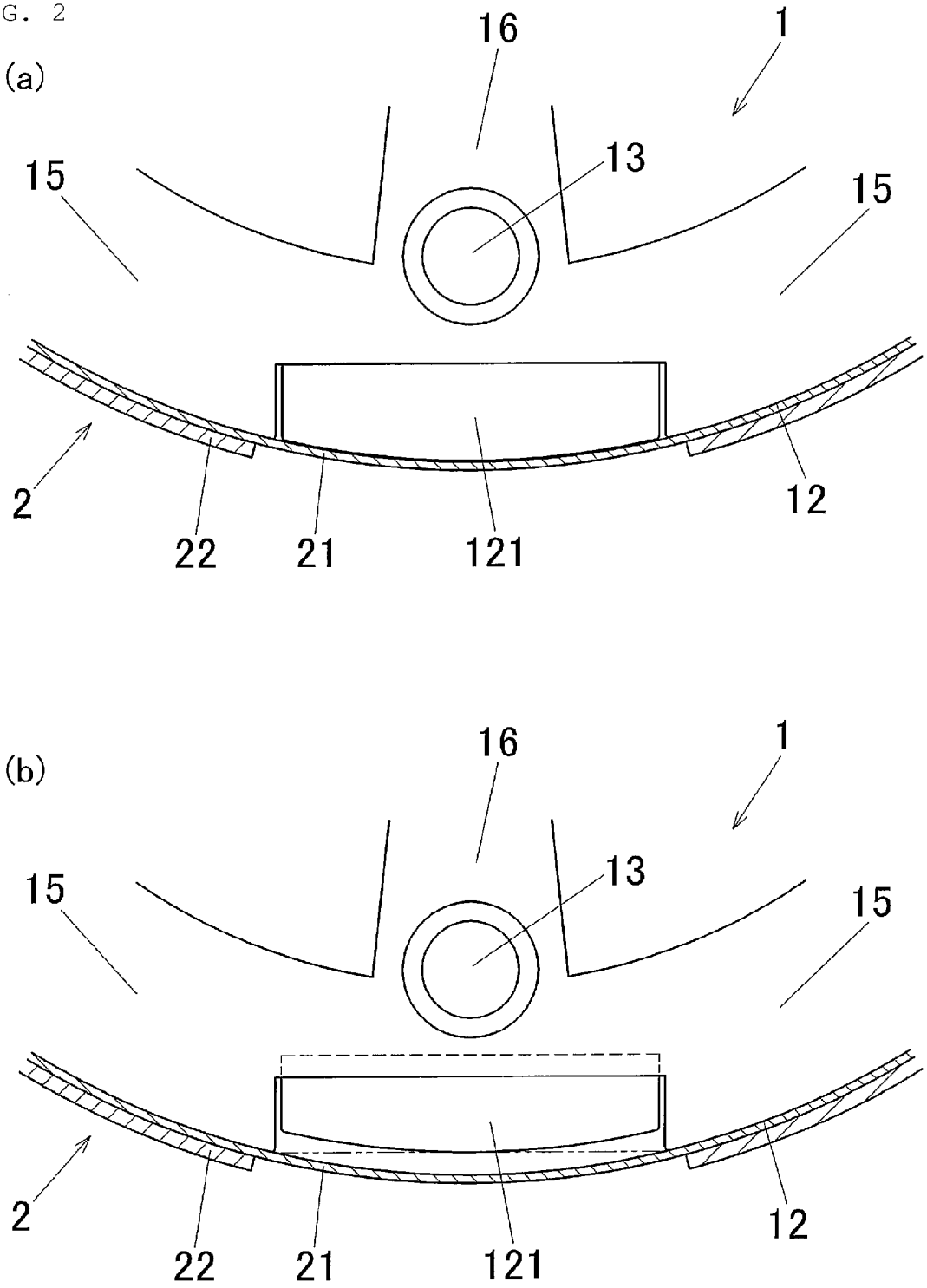
FIG. 2 is an explanatory view of a plate securing member of a plate attachment device shown in FIG. 1.
Figure 3:
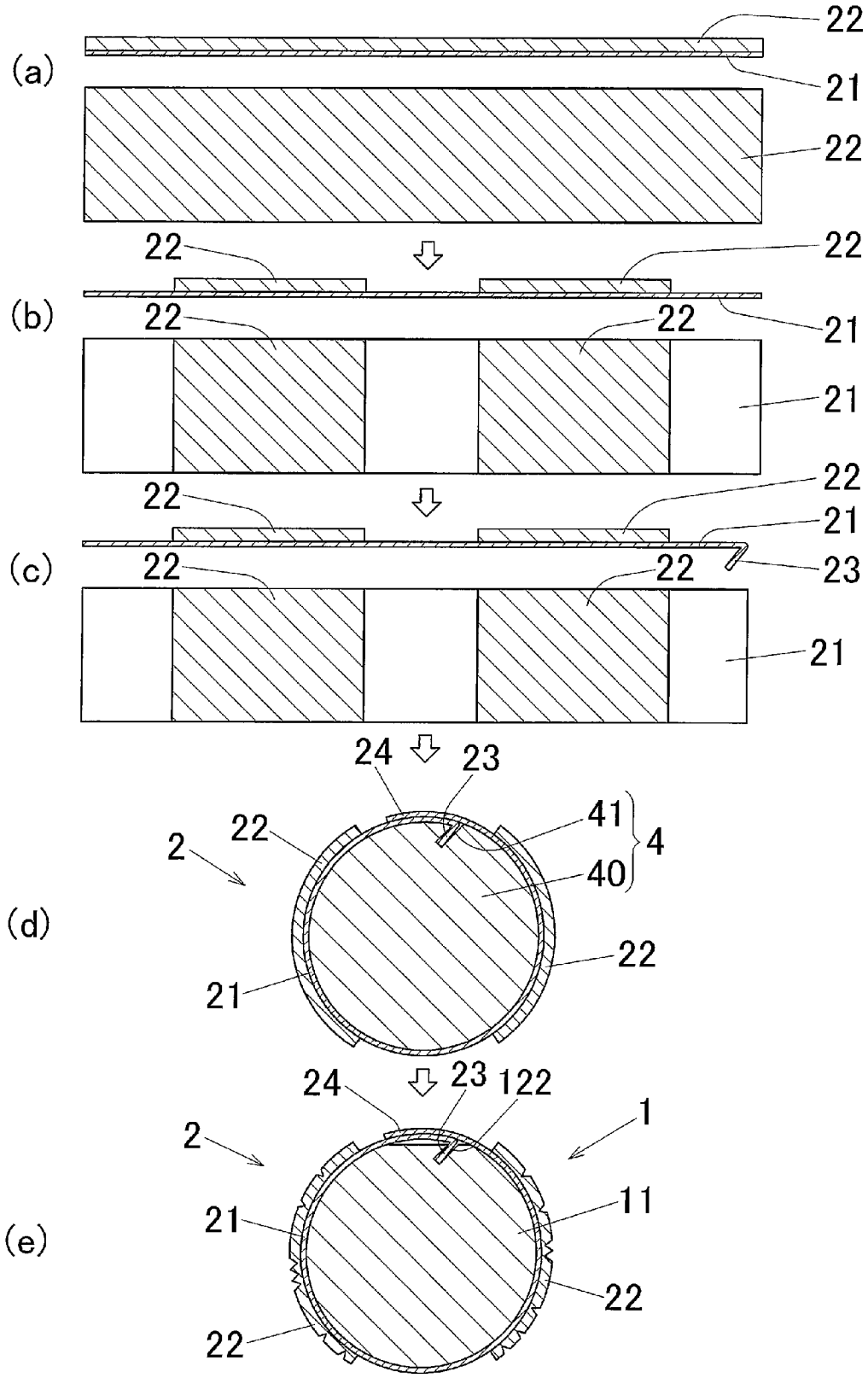
FIG. 3 is an explanatory view of the printing plate attached to the plate attachment device shown FIG. 1.
Figure 7:
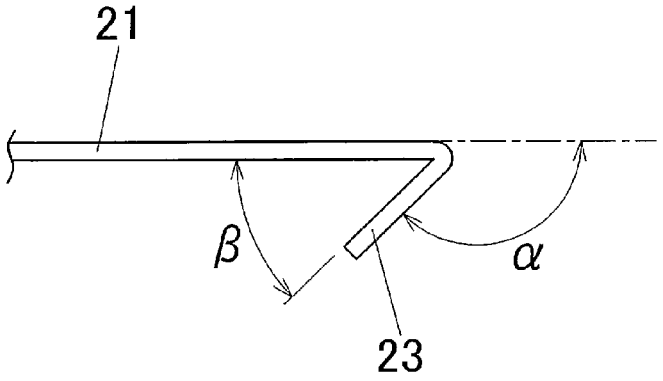
FIG. 7 is an explanatory view of the engaging portion of the plate attachment device shown in FIG. 1.
Figure 8:
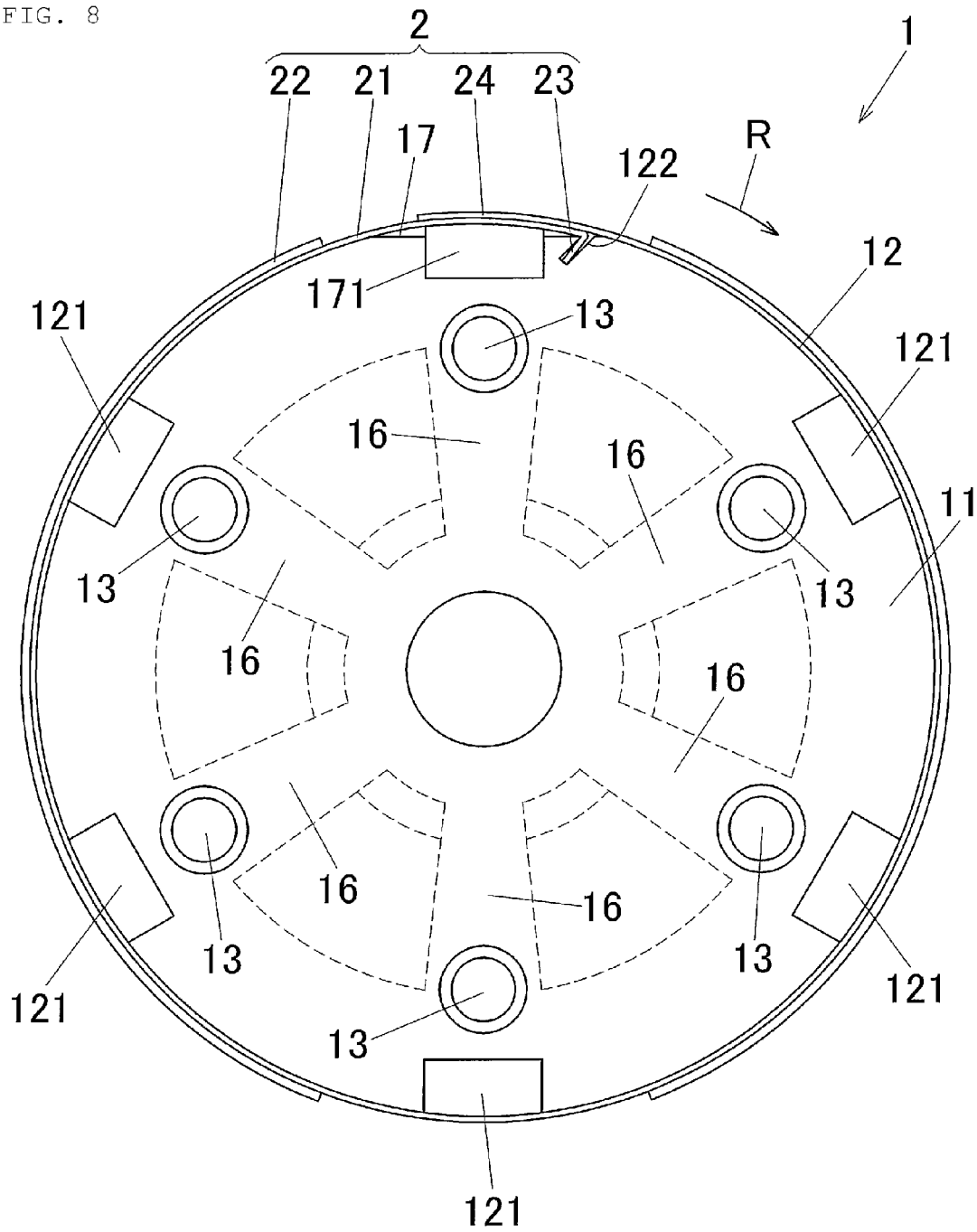
FIG. 8 is a front view of a plate attachment device according to another embodiment of the present invention.

FIG. 1 is a front view of a plate attachment device 1 to which a printing plate 2 is attached. FIG. 2 is an explanatory view of the printing plate 2 attached to the plate attachment device 1 shown in FIG. 1. FIG. 3 is an explanatory view of a production process of the printing plate 2 shown in FIG. 1. FIGS. 4 to 7 are explanatory views showing the plate attachment device 1 shown in FIG. 1. FIG. 8 is a front view of the plate attachment device 1 having printing plate securing members 121 more than the plate attachment device 1 as shown in FIG. 1.

(Printing Plate)

A printing plate 2 includes a plate main body 21 formed into a cylindrical shape and made of elastic material, an engaging portion 23 inwardly protruding from an inner periphery of the plate main body 21 and extending in an axial direction of the plate main body 21, and a printing portion 22 formed on a part of an outer peripheral portion of the plate main body 21.

Figure 4:
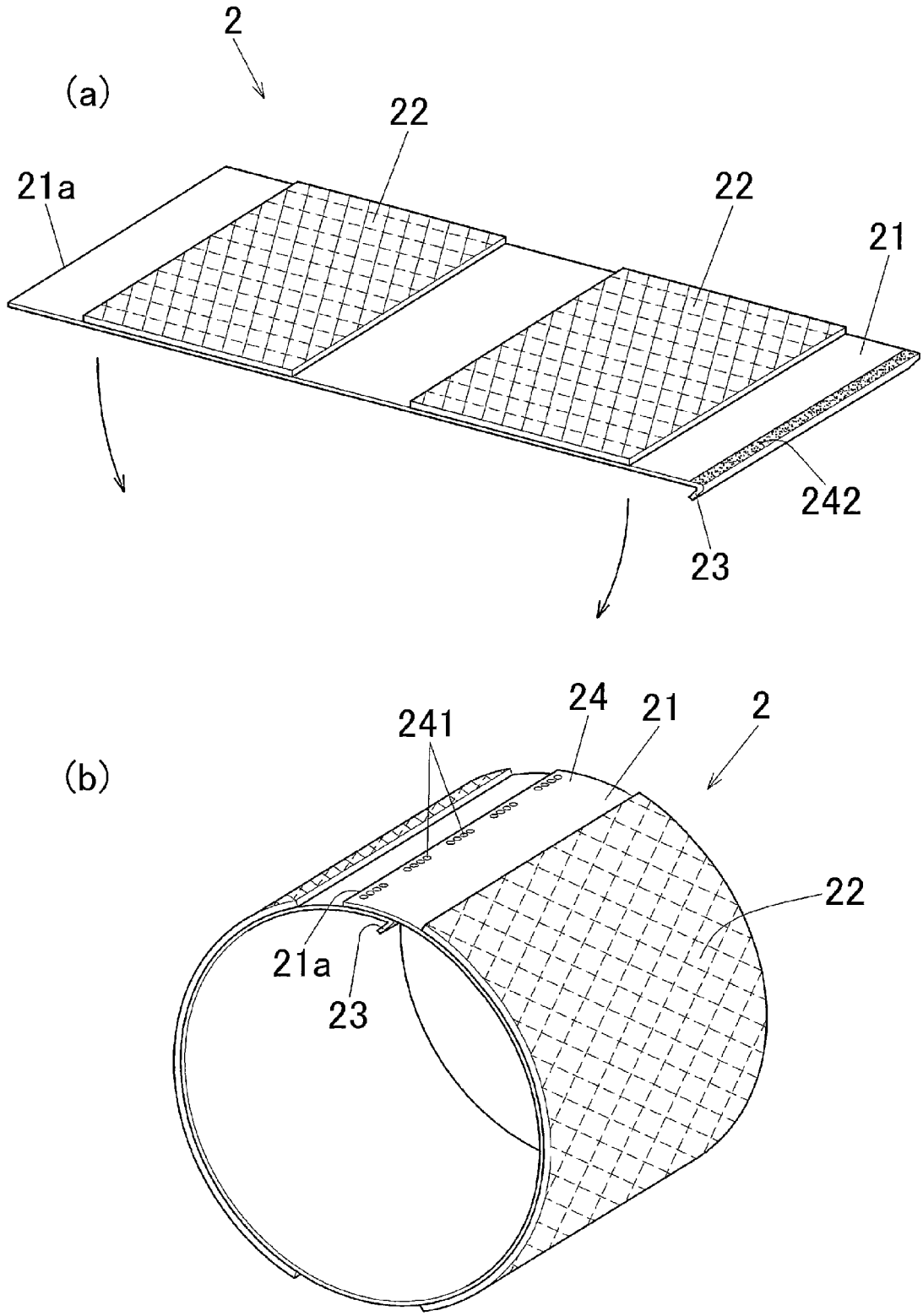
FIG. 4 is an explanatory view of the printing plate attached to the plate attachment device shown in FIG. 1.

As shown in FIGS. 3 and 4, the plate main body 21 is made of an elastic material sheet of, e.g., a rectangular shaped metal (hereinafter simply referred to as "sheet"). The plate main body 21 is formed by forming the sheet into a cylindrical shape and joining both end portions thereof in an overlapped manner. The printing portion 22 is formed at a predetermined position on the outer peripheral surface of the plate main body 21 other than the joint portion 24.

On one surface of the sheet, i.e., an outer surface of the sheet formed into a cylinder shape, a resin layer which will constitute the printing portion 22 is formed. This resin layer can be made of a resin, such as, e.g., polyvinyl alcohol series resin, vinyl ester series resin, polyamide series resin, etc., preferably having a Shore Durometer Hardness of about D20-80 after hardening.

The following explanation is directed to one example of a method for producing a printing plate 2 in which an UV curable resin (ultraviolet curable resin) for a normal offset printing having a prescribed thickness (for example, 0.57 mm) is adhered to a tin plate (Fe) having a prescribed thickness (for example, 0.26 mm). By using an ultraviolet curable resin, cleaning operation can be easily performed normally with water without the need for complicated cleaning operations using a solvent required for curable resins other than the ultraviolet curable resin or using high pressure steam. As to a thickness of the resin layer, it is sufficient to have a thickness required as the printing portion 22.

As to a thickness of the sheet, it is sufficient to have a thickness capable of being formed into a cylindrical shape and maintaining the cylindrical shape by the elastic force. The thickness is not specifically limited to the aforementioned numerical value.

At the inside of the joint portion 24, an engaging portion 23 is formed by inwardly bending the end portion of the sheet. This engaging portion 23 functions as a protruded member for positioning the sheet in the circumferential direction relative to the plate cylinder 11.

Hereinafter, the angle $\alpha$ (alpha) defined by an angle of the engaging portion 23 bent from a flat state of the sheet shown by a dashed line will be referred to as a bent angle, and an angle $\beta$ (beta) between the engaging portion 23 and a portion of the sheet adjacent to the engaging portion 23 will be referred to as an angle between the sheet and the engaging portion (see FIG. 7).

The bent angle $\alpha$ is preferably larger than 90 degrees (the angle $\beta$ between the sheet and the engaging portion is smaller than 90 degrees), more preferably 125-145 degrees (the angle $\beta$ between the sheet and the engaging portion is 35-55 degrees). The bent angle $\alpha$ is most preferably 135 degrees. The following explanation will be directed to the case in which the bent angle $\alpha$ is around 135 degrees and the angle $\beta$ between the sheet and the engaging portion is around 45 degrees.

(Method for Producing Printing Plate)

In a sheet cut into a rectangular shape of a predetermined size which will constitute the printing plate 2, an ultraviolet ray is irradiated onto the portions of the sheet to be formed into the printing portions 22 to cure the portions of the sheet, and the resin layers of portions of the sheet not to be formed into the printing portions 22, i.e., uncured portions of the resin layer to be formed into non-printing portions, are washed away with water and removed. Removing the resin layers on the non-printing portions facilitate bending of the sheet, resulting in an easy bending work for bending the sheet into a cylindrical shape.

In this specification, before completion of the printing plate 2, the printing portion 22 is defined to include an uncured resin layer which will become the printing portion 2.

One end portion of the rectangular sheet is bent toward the side of the sheet in which no resin layer is formed (hereinafter referred to as "inward") to form the engaging portion 23. It is enough that the engaging portion 23 bent in the inward direction of the sheet has a length capable of being assuredly engaged with the groove portion 41 formed in the cylinder 40 of the cylinder member 4, or the circumferential positioning groove 122 formed in the plate cylinder 11 of the plate attachment device 1 when the engaging portion 23 is attached to the cylinder member 4 of the cylinder material at the step of forming a cylinder member or to the following plate attachment device 1 of an engraving machine or a printing machine. In this embodiment, the engaging portion 23 is bent to have a length of, e.g., 4 mm.

The sheet having the engaging portion 23 is wrapped around the cylinder member 4 for, e.g., forming a cylinder member, and both end portions of the sheet are overlapped and secured with each other with the sheet formed into a cylindrical shape. The groove portion 41 is formed in the outer peripheral surface of the cylinder member 4 so that the sheet can be wrapped around the outer peripheral surface of the cylinder 40 with the engaging portion 23 of the sheet engaged with the groove portion 41 of the cylinder member 4.

In this manner, both end portions of the sheet are overlapped and secured with each other with a joining means to obtain a cylindrically formed printing plate 2. Thereafter, printing patterns are engraved to the printing portion 22 of the printing plate 2.

The aforementioned joining means can be any joining means as long as a sheet joining strength can be secured. For example, before wrapping the sheet around the cylinder member 4, an adequate adhesive agent 242 is previously applied to one surface of one end portion of the sheet having the engaging portion 23, the one surface being located at an opposite side of the engaging portion 23. The sheet is wrapped around the outer peripheral surface of the cylinder 40 and formed into a cylindrical shape. The end portion 21*a* of the other end of the sheet is overlapped onto the outside of the adhesive agent 242 to be joined. As needed, the joint portion 24 can be strongly joined by spot welding like spot welding portions 241 as shown in FIG. 4(*b*).

Figure 5:
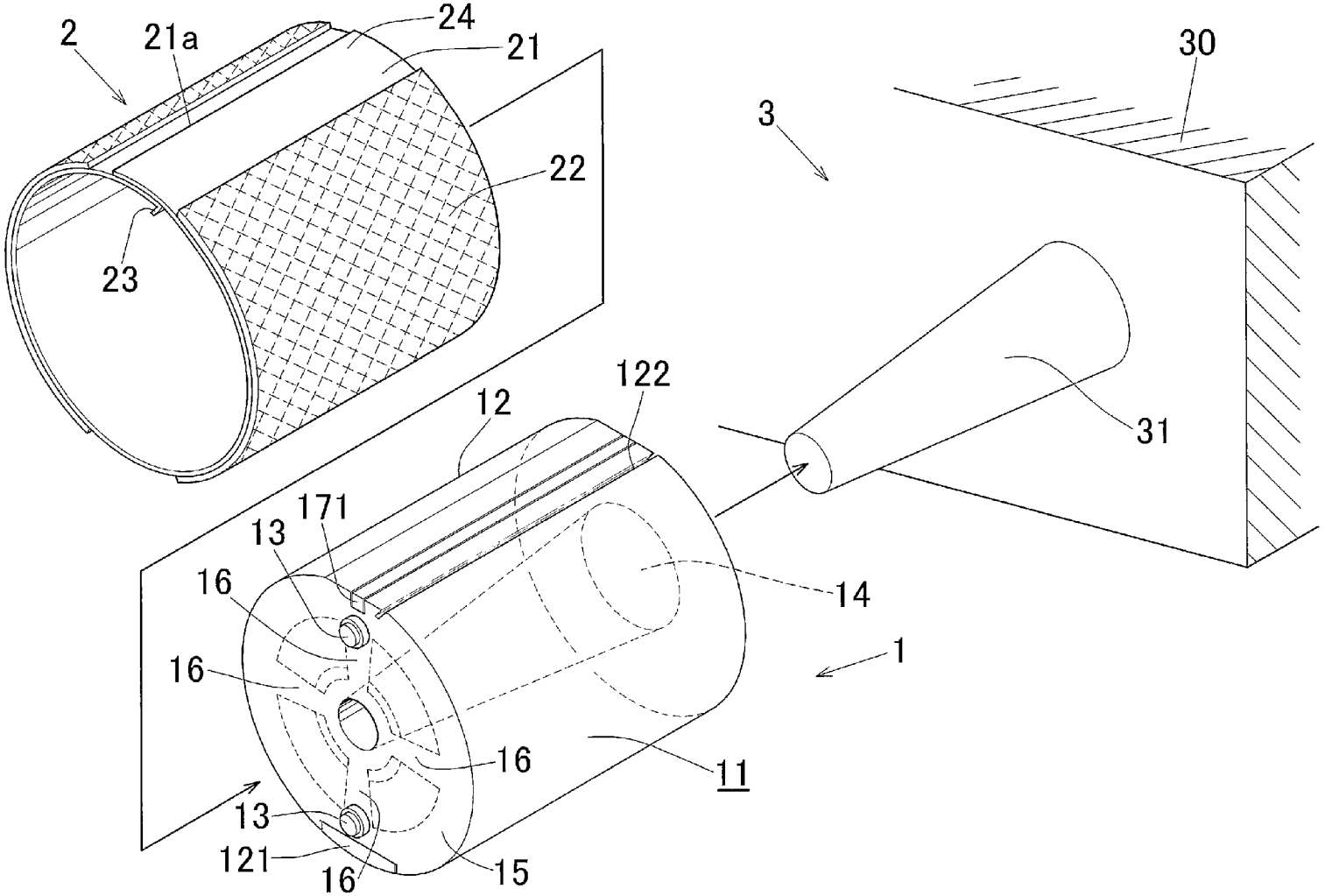
FIG. 5 is an explanatory view of the printing plate attached to the plate attachment device shown in FIG. 1.
Figure 6:
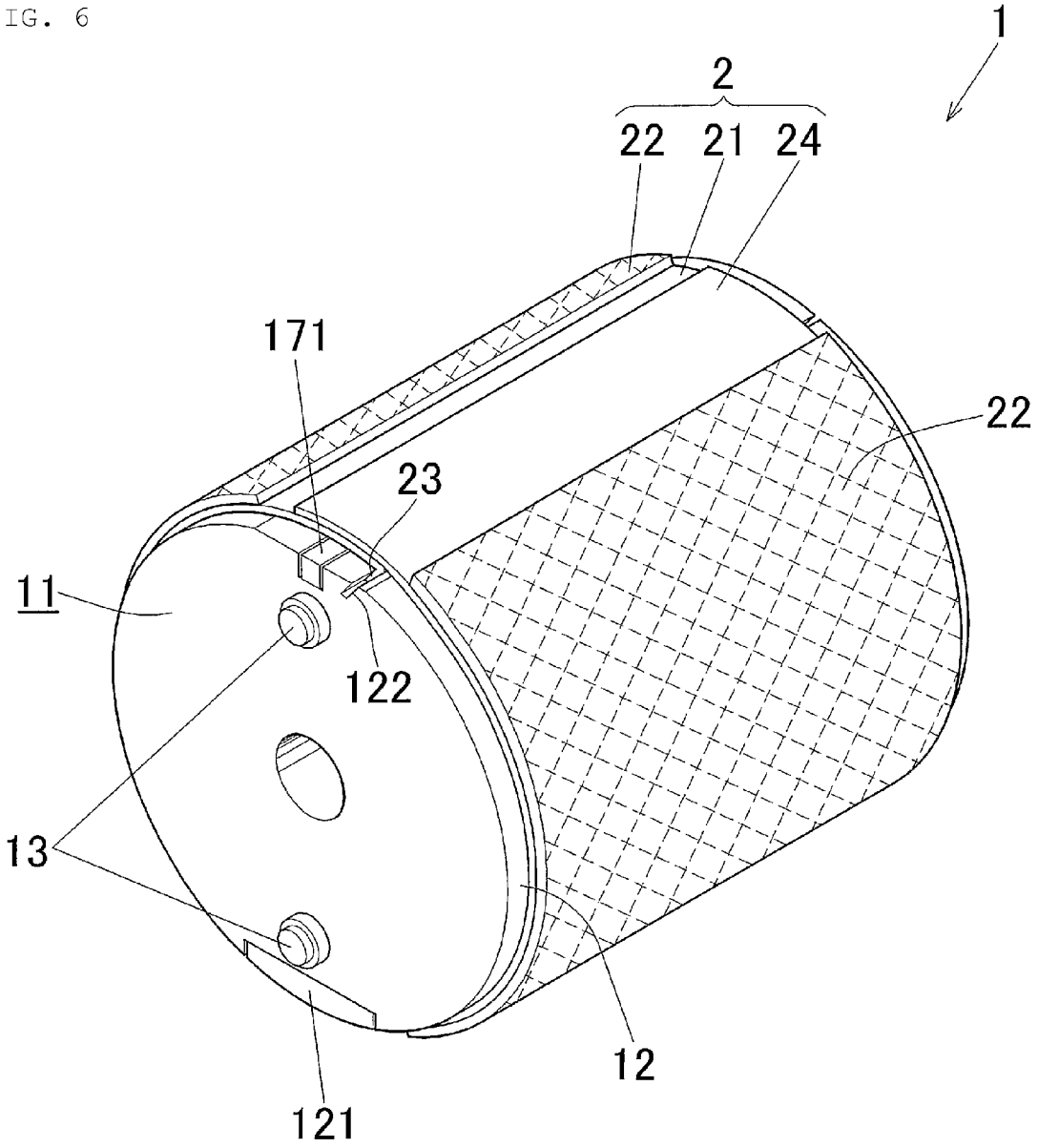
FIG. 6 is an explanatory view of the printing plate attached to the plate attachment device shown in FIG. 1.

As shown in FIGS. 5 and 6, the printing plate 2 formed into a cylindrical shape is attached to the plate cylinder 11 of the plate attachment device 1, which will be described later, so as to fit on the outer periphery thereof.

(Plate Attachment Device)

The structure of the plate attachment device 1 to be mounted on a printing machine 3 for making prints on a printing object will be explained with reference to FIGS. 1 and 5. The plate attachment device 1 can be a device commonly provided at an engraving machine for engraving printing patterns on a printing plate 2 used for the printing machine 3.

The printing machine 3 includes a bearing housing 30 provided at a machine casing. The bearing housing 30 supports a plate drive shaft 31 in a rotatable manner. The plate drive shaft 31 provided at the bearing housing 30 is rotatable at a predetermined speed in a predetermined direction, such as, e.g., a clockwise direction. As a driving means for rotating the plate drive shaft 31, any known technologies can be employed.

The front portion of the plate drive shaft 31 protrudes forward from the bearing housing 30. The front end portion of the plate drive shaft 31 arranged forward of the bearing housing 30 is formed into a tapered portion with the tip end tapered. The plate attachment device 1 is configured to be fixed to the tapered portion of the plate drive shaft 31 in a detachable manner.

The plate attachment device 1 is provided with a plate cylinder 11 to be fitted on the outer periphery of the plate drive shaft 31 and having a cylindrical plate attaching surface 12 to which the printing plate 2 is attached from the tip end side of the plate drive shaft 31. The plate cylinder 11 is formed into a cylindrical shape, and is provided with a tapered hole 14 smaller in inner diameter at the front side at an axial center and a cylindrical plate attaching surface 12 coaxial with the plate drive shaft 31 on the outer periphery.

For the purpose of reducing the weight of the plate cylinder 11, inner portions thereof are removed at plural positions in the circumferential direction of the plate cylinder 11 (four positions in this embodiment). In this way, the plate cylinder 11 includes an axial tapered cylinder portion having a tapered hole 14 therein, an external cylinder portion 15 having the plate attaching surface 12 on the outer periphery, and a plurality of joining portions 16 (four joining portions in this embodiment) joining the axial tapered cylinder portion and the external cylinder portion. The plate cylinder 11 is fixed to the plate drive shaft 31 in a state in which the tapered portion of the plate drive shaft 31 is fit into the tapered hole 14. The plate cylinder 11 rotates integrally with the plate drive shaft 31. The rotational direction of the plate cylinder 11 is shown with an arrow R in FIGS. 1 and 8.

The plate attaching surface 12 preferably has a surface roughness of about Ra 1 μm or less to maintain a static friction for the purpose of securing a fixing force by the friction resistance between the plate attaching surface 12 and the inner surface of the printing plate 2 attached to the plate attaching surface 12. In light of maintaining the surface roughness small and improving the scratch resistance on the surface, the plate attaching surface 12 is preferably coated (plated) by hard chrome.

At a portion of the external cylinder portion 15 of the plate cylinder 11 corresponding to the upper joining portion 16, the cylindrical surface is partially removed to form a flat cutout portion 17. The surface of the cutout portion 17 is a surface for attaching the plate securing member 171 which will be explained later. A portion of the outer periphery of the external cylinder portion 15 excluding the cutout portion 17 constitutes the plate attaching surface 12. The plate attaching surface 12 means the outer peripheral surface of the plate cylinder 11 including the plate securing member 121, which comes into contact with the inner peripheral surface of the printing plate 2 when the printing plate 2 is attached.

On the outer peripheral surface of the plate cylinder 11, a circumferential positioning groove 122 into which the engaging portion 23 of the printing plate 2 is to be fitted from the tip end side of the plate drive shaft 31 is formed at the front side of the cutout portion 17 in the rotational direction thereof.

The angle between the circumferential positioning groove 122 and the cylindrical surface including the plate attaching surface 12 is approximately equal to the angle β between the sheet and the engaging portion of the engaging portion 23 of the printing plate 2. The circumferential positioning groove 122 is formed such that the bottom portion thereof is arranged rearward of the opening portion thereof in the rotational direction.

The angle between the circumferential positioning groove 122 and the cylindrical surface including the plate attaching surface 12 is preferably set to be smaller than the angle β between the sheet and the engaging portion. In this case, as shown in FIG. 1, after the attachment, the bent portion of the engaging portion 23 is brought into contact with a portion of the inner surface of the circumferential positioning groove 122 closer to the engaging portion 23 and the tip end of the engaging portion 23 is brought into contact with a portion of the inner surface of the circumferential positioning groove 122 away from the engaging portion 23. Thus, the engaging portion 23 is supported at two longitudinal points in the width of the circumferential positioning groove 122. As a result, the printing plate 2 is positioned immovably, which prevents any displacements of the printing plate 2 due to the rotation of the printing plate 2 even after the attachment.

(Plate Securing Member)

As shown in FIGS. 1 and 2, at a portion positioned rearward of the circumferential positioning groove 122 formed in the outer periphery of the plate cylinder 11 in the rotational direction, a plate securing member 171 (hereinafter referred to as "first plate securing member") movable in both the radially outward and inward directions of the plate cylinder 11 is provided. Also, at the lower side of the outer circumference of the plate cylinder 11, a plate securing member 121 (hereinafter referred to as "second plate securing member") having the same function as the first plate securing member is provided. In other words, on the outer periphery of the plate cylinder 11, a plurality of plate securing members 171 and 121 movable in both the radially outward and inward directions of the plate cylinder 11 are provided.

An operating portion 13 of a rotary dial type is arranged in the vicinity of each of the plate securing members 171 and 121. The plate securing members 171 and 121 are each configured so as to move radially outward and inward of the plate cylinder 11 in accordance with the rotational operation of the corresponding operating portion 13.

For example, it can be configured such that a dented portion of a rectangular shape in cross-section extending in the axial direction is formed on the outer periphery surface of the plate cylinder 11 and that the plate securing member 171 and 121 is fitted in the dented portion so as to be moved in the radially inward and outward directions in accordance with the operation of the operating portion 13. With this structure, the plate securing members 171 and 121 can be each fitted in the dented portion with no gap therebetween in both the circumferential direction of the plate cylinder and the axial direction of the plate drive shaft and can be moved in the radial direction along both the circumferential end walls and the axially extending wall of the dented portion.

At least a part of each of the plate securing members 171 and 121 mounted on the plate cylinder 11, which can be, for example, a contact surface which is a surface of the second plate securing member 121 in contact with the inner periphery portion of the printing plate 2, is formed into a curved shape having the same or approximately same curvature as the outer periphery surface of the plate cylinder 11.

For example, by forming the contact surface of the second plate securing member 121 in contact with the inner periphery portion of the printing plate 2 into a curved surface having the same curvature as the outer periphery surface of the plate cylinder 11, even if the second plate securing member 121 is moved radially outward of the plate cylinder 11, the likelihood of deformations such as bending of the printing plate 2 can be decreased. Further, since the contact surface of the second plate securing member 121 has the same curvature, i.e., the so-called R shape, as the outer periphery surface of the plate cylinder 11, the degree of adhesion with the plate cylinder 11 can be further improved.

It is preferred that the plate securing members 171 and 121 are each structured so as to move in the radial direction of the plate drive shaft 31 along the joining portion 16 of the plate cylinder 11. With this structure, the movable range of the plate securing members 171 and 121 in the radial direction can be increased.

The plate securing members 171 and 121 are each structured to be movable in the radially inward and outward of the plate cylinder 11. However, the purposes of the plate securing members 171 and 172 can be different. For example, the first plate securing member 171 formed in the cutout portion 17 can be provided to fix the printing plate 2 to thereby prevent possible displacements of the printing plate 2. On the other hand, the second plate securing member 121 arranged on the opposite side of the cutout portion 17 is can be provided to adjust the circumferential length of the outer periphery of the plate cylinder 11 so as to attain a close contact between the plate attaching surface 12 and the printing plate 2 at the time of printing and to enable an easy attachment/detachment of the printing plate 2 by securing a sufficient gap between the plate attaching surface 12 and the inner periphery surface of the printing plate 2 at the time of the attachment/detachment.

For example, it is configured such that the circumferential length of the plate attaching surface 12 of the plate cylinder 11 when the second plate securing member 121 is moved in the radially inward direction of the plate cylinder 11 becomes essentially shorter than the circumferential length formed by the plate attaching surface 12 of the plate cylinder 11 when the second plate securing member 121 is set to a standard state.

The standard state of the second plate securing member 121 denotes a state as shown in FIG. 2(*a*) in which the contact surface of the second plate securing member 121 in contact with the printing plate 2 is positioned on the plate attaching surface of the outer periphery of the plate cylinder 11.

Specifically, the circumferential length of the inner peripheral surface of the printing plate 2 is slightly larger when compared to the circumferential length of the printing plate 2 in the state in which the second plate securing member 121 provided on the plate attaching surface 12 of the plate cylinder 11 is moved inward of the plate cylinder 11 so that the second plate securing member 121 is positioned inner than the cylindrical surface of the plate attaching surface 12 (see FIG. 2(*b*)). This occurs because, when the second plate securing member 121 is moved inward of the plate cylinder 11, for example, the outer periphery surface of the second plate securing member 121 of the plate attaching surface 12 partially constituting the circumferential length of the plate cylinder 11 changes to the linear position as shown by the two-dot chain line from the position matched with the cylindrical surface of the plate cylinder 11, resulting in a shortened circumferential length of the plate cylinder 11.

The second plate securing member 121 is configured to be moved from the radially outward side of the plate cylinder 11 toward the radially inward side thereof to shorten the circumferential length of the plate cylinder 11. Therefore, a sufficient space can be secured between the printing plate 2 and the plate attaching surface 12 when the printing plate 2 is set to have a circumferential length slightly larger than the circumferential length of the outer peripheral surface of the plate cylinder 11 in a state in which the circumferential length of the plate cylinder 11 becomes short. As a result, the printing plate 2 can be easily detached from the plate cylinder 11.

By operating the operating portion 13, the second plate securing member 121 is moved in the pres sing direction, i.e., in the radially outward direction, to be pressed against the inner peripheral portion of the printing plate 2 not having the joint portion 24, so that the second plate securing member 121 is brought into a pressing state in which the second plate securing member 121 presses the printing plate 2 from the inside of the printing plate 2 to radially outward. At this time, a predetermined tension is applied to the printing plate 2 by the second plate securing member 121. As a result, the printing plate 2 is closely attached to the plate attaching surface 12 of the plate cylinder 11. In this state, the operation of the operating portion 13 is stopped to fix the position of the second plate securing member 121.

As explained above, it is configured such that the contact surface of the second plate securing member 121, which is at least a part of the plate securing members 171 and 121, is aligned with the plate attaching surface of the plate cylinder 11. With this structure, the contact surface of the second plate securing member 121 forms a part of a cylindrical surface aligned with or approximately aligned with the plate attaching surface 12 of the plate cylinder 11. This does not cause any deformation of the printing plate 2, resulting in less occurrence of misalignment of a printing image.

The inner circumferential length of the printing plate 2 to be attached to the plate attachment device 1 is, when the second plate securing member 121 is set to be in the standard state, set to be equal to or approximately equal to the circumferential length of the plate cylinder 11.

When detaching the printing plate 2 attached to the plate cylinder 11, the operating portion 13 is operated to release the pressing of the printing plate 2 to move the second plate securing member 121 toward the pressure releasing direction, i.e., in the radially inward direction of the plate cylinder 11. With this operation, gaps are formed between the plate attaching surface 12 and the printing plate 2 and between the second plate securing member 121 and the printing plate 2. This allows the printing plate 2 to be moved in the axial direction, enabling an easy removal of the printing plate 2 from one end of the plate cylinder 11.

As explained above, the plate securing members 171 and 121 are configured to be movable in both radially outward and inward directions of the plate cylinder 11. This enables adjustment of the circumferential length of the outer periphery of the plate cylinder 11. As a result, the printing plate 2 can be brought into close contact with the plate attaching surface 12 at the time of printing, and the printing plate 2 can be easily detached/attached while securing a sufficient space between the plate attaching surface 12 and the printing plate 2 at the time of attachment/detachment of the printing plate 2.

(Method of Attaching/Detaching Printing Plate)

The following explanation will be directed to a method of attaching/detaching a printing plate 2 to the plate cylinder 11 provided with two plate securing members, i.e., the first plate securing member 171 and the second plate securing member 121, as shown in FIG. 1.

The first plate securing member 171 provided at the cutout portion 17 and the second plate securing member 121 provided at a position opposing the cutout portion 17 are moved in a radially inward direction of the plate cylinder 11 to set the circumferential length of the plate cylinder 11 to be short. In other words, the circumferential length of the plate cylinder 11 is adjusted to be shorter than the circumferential length of the inner periphery of the printing plate 2 in advance, so that the printing plate 2 can be easily attached to the plate cylinder 11.

As shown in FIG. 5, in a state in which the circumferential length of the outer periphery of the plate cylinder 11 attached to the plate drive shaft 31 is set to be shorter than the circumferential length of the inner periphery of the printing plate 2, the printing plate 2 is attached to the plate cylinder 11 from the tip end side of the plate drive shaft 31.

When attaching the printing plate 2, the printing plate 2 is attached in a state in which the contact surfaces of the first plate securing member 171 and the second plate securing member 121 to the printing plate 2 are arranged at a position inner than the plate attaching surface 12 of the plate cylinder 11. Therefore, the printing plate 2 can be easily attached.

Subsequently, the second plate securing member 121 is moved radially outward of the plate cylinder 11 so that the contact surface of the second plate securing member 121 is in the standard state. Furthermore, the first plate securing member 171 is moved radially outward of the plate cylinder 11 so that the plate attaching surface 12 of the outer periphery of the plate cylinder 11 and the inner peripheral surface of the printing plate 2 are brought into close contact with each other to thereby attach the printing plate 2 to the plate attaching surface 12 of the plate cylinder 11.

When closely fixing the printing plate 2 and the plate cylinder 11, the first plate securing member 171 is brought into contact with the inner side of the printing plate 2 to increase the circumferential length of the plate cylinder 11 by pushing out the printing plate 2 from the inside thereof so that the outer circumferential length of the printing plate 2 becomes equal to the inner circumferential length of the printing plate 2. Therefore, the degree of adhesion between the plate cylinder 11 and the plate attaching surface 12 can be improved.

For example, in cases where only one plate securing member 171 is provided on the plate cylinder 11, the amount of change in the circumferential length of the plate cylinder 11 can be increased by moving a larger plate securing member 171 radially outward or inward of the plate cylinder 11. However, the operational burden for moving the plate securing member 171 increases in proportion to the size of the plate securing member 171. However, by providing a plurality of plate securing members 171 and 121, individual plate securing members 171 and 121 can be made smaller and lighter, and the operational burden for moving the plate securing members 171 and 121 can be reduced.

The printing is initiated in a state in which the printing plate 2 is closely fixed to the outer periphery of the plate cylinder 11.

Since the plate cylinder 11 and the printing plate 2 are constituted as explained above, even in the case of printing patterns on a printing object with the printing machine 3, the plate cylinder 11 can be rotated in a state in which the printing plate 2 is fixed to the plate cylinder 11 as described above. At this time, the printing plate 2 is closely fixed to the plate attaching surface 12 by the plate securing members 171 and 121 and that the engaging portion 23 bites into the circumferential positioning groove 122 since the tip end side of the engaging portion 23 of the printing plate 2 faces the rear side of the rotational direction R, which causes no displacement of the printing plate 2.

When detaching the printing plate 2, the plurality of plate securing members 171 and 121 are moved radially inward of the plate cylinder 11 to make the outer circumferential length of the plate cylinder 11 shorter than the inner circumferential length of the plate cylinder 11 again. Thus, a sufficient space is secured between the plate attaching surface 12 and the printing plate 2, which enables an easy detachment of the printing plate 2 from the plate cylinder 11.

In the aforementioned explanation, for example, when attaching the printing plate 2 to the plate cylinder 11, it is explained that the attaching operation is performed in a state in which the contact surface of the second plate securing member 121 is positioned radially inward of the plate attaching surface 12 of the plate cylinder 11. However, in cases where a sufficient space is secured between the plate attaching surface 12 and the printing plate 2 without moving both the plate securing members 171 and 121, the printing plate 2 can be attached to the plate cylinder 11 in a state in which the contact surface of the second plate securing member 121 is positioned in the standard state.

Further, in cases where a gap is formed between the plate attaching surface 12 and the printing plate 2 when closely fixing the printing plate 2 to the plate cylinder 11 by moving the first plate securing member 171 radially outward of the plate cylinder 11 in a state in which the contact surface of the second plate securing member 121 is positioned in the standard state, the second plate securing member 121 can be moved radially outward of the plate cylinder 11 so that the contact surface of the second plate securing member 121 protrudes radially outward of the plate attaching surface 12. In this embodiment, since it is structured that the second plate securing member 121 is arranged at a position in which the printing portion 22 is not formed, misalignment of a printing image less likely occur with such operation.

(Modified Embodiment)

The above description is directed to a plate attachment device 1 having two plate securing members 171 and 121, but the present invention is not limited to it. The following explanation will be directed only to the differences between the aforementioned embodiment and the modified embodiment.

For example, as shown in FIG. 8, the plate attachment device 1 can be provided with three or more second plate securing members 121 movable radially inward and outward of the plate cylinder 11, similarly to the aforementioned plate securing members 171 and 121.

In this case, since a plurality of second plate securing members 121 are provided, when the circumferential length of the outer periphery of the plate cylinder 11 is shortened by moving each second plate securing member 121 radially inward of the plate cylinder 11, the difference between the circumferential length of the plate cylinder 11 and the circumferential length of the printing plate 2 is increased. This enables more easy attachment/detachment of the printing plate 2.

For example, at the time of attaching and detaching the printing plate 2, the printing plate 2 can be attached/detached in a state in which the contact surfaces of all of the fixing members of the plurality of first plate securing members 171 and second plate securing members 121 provided on the plate cylinder 11 are positioned radially inward of the plate attaching surface 12 of the plate cylinder 11.

When closely fixing the printing plate 2 to the plate attaching surface 12, the contact surfaces of all of the second plate securing members 121 are positioned in the standard state, and thereafter the first plate securing member 171 is moved radially outward of the plate cylinder 11 to closely fix the plate attaching surface 12 of the outer periphery of the plate cylinder 11 and the inner periphery surface of the printing plate 2 to thereby attach the printing plate 2 to the plate attaching surface 12 of the plate cylinder 11.

The contact surface of the second plate securing member 121 arranged at the position at which the printing portion 22 is provided must be positioned at the standard state. Setting the contact surface of the second plate securing member 121 in the standard state causes no deformation and/or bending of the printing portion 22, which in turn less likely causes misalignment of a printing image. The second plate securing members 121 arranged at other positions are not required to be set in the standard state.

Further, since a plurality of second plate securing members 121 can be provided on the outer periphery of the plate cylinder 11, each second plate securing member 121 can further be reduced in size and weight, which in turn can reduce the operational burden at the time of moving the second plate securing member 121.

The plurality of first plate securing members 171 and second plate securing members 121 are arranged at symmetrical positions on a circumference of circle of the plate cylinder 11. Since each of the plate securing members 171 and 121 is arranged at each of the symmetrical positions on a circumference of circle of the plate cylinder 11, the weight balance of the plate cylinder 11 is well arranged, resulting in a smooth rotary motion during printing.

In cases where a plurality of second plate securing members 121 are provided, it is not always required to operate all of the second plate securing members 121. For example, when attaching the printing plate 2, in cases where there is a sufficient space between the printing plate 2 and the plate attaching surface 12 in a state in which the contact surface of the first plate securing member 171 and the contact surface of one second plate securing member 121 are positioned radially inward of the plate attaching surface 12, it is not required to position the contact surfaces of all of the second plate securing members 121 radially inward of the plate attaching surface 12.

The overall structure and the structure of each part of the aforementioned printing machine 3, plate attachment device 1 and printing plate 2 are not limited to the aforementioned embodiments and can be arbitrarily changed.

For example, the plurality of plate securing members 171 and 121 are preferably arranged at symmetrical positions on a circumference of circle of the plate cylinder 11, but not limited to such structure. The printing plate 2 can be configured such that a separately formed engaging portions 23 is fixed to a cylindrical plate main body 21. Further, a cylinder member without no joint can be used.

In the aforementioned embodiments, the operating portion 13 is illustrated as a rotary dial type operating portion 13, but it can be a push type operating portion 13. Further, the plate securing members 171 and 121 can be moved with power such as electrical power or can be moved by hand. The structure of the operating portion 13 can be arbitrarily designed.

An operating portion 13 is provided for each plate securing member 171 and 121, but it is not limited to that structure. It can be structured such that a plurality of plate securing members 171 and 121 are simultaneously operated by one operating portion 13.

Further, even in cases where printing portions 22 are arranged at different positions depending on printing plates 2, it can be configured such that printing can be performed using the same plate attachment devices 1.

For example, it can be configured such that a plurality of plate securing members 171 and 121 are provided on the plate cylinder 11, and that based on the positional condition of the printing portion 22 of the attached printing plate 2, only the plate securing members 121 arranged at portions corresponding to the non-printing portion among the provided plate securing members 171 and 121 are selectively moved radially outward of the plate cylinder 11.

The numerical values in the above description can be arbitrarily designed, and not limited to the them.

The aforementioned embodiments are only examples of the present invention and specific structure can be arbitrarily changed within the range of exerting the effects of the present invention.

This application claims priority to Japanese Patent Application No. 2010-226918 filed on Oct. 6, 2010, and the entire disclosure of which is incorporated herein by reference in its entirety.

It should be understood that the terms and expressions used herein are used for explanation and have no intention to be used to construe in a limited manner, do not eliminate any equivalents of features shown and mentioned herein, and allow various modifications falling within the claimed scope of the present invention.

INDUSTRIAL APPLICABILITY

The present invention can be used to attach a printing plate.

DESCRIPTION OF THE REFERENCE NUMERALS

1: plate attachment device
2: printing plate
3: printing machine
11: plate cylinder
12: plate attaching surface
21: plate main body

22: printing portion
23: engaging portion
31: plate drive shaft
121: plate securing member (second plate securing member)
122: circumferential positioning groove
171: plate securing member (first plate securing member)

The invention claimed is:

1. A plate attachment device to be fixed to a plate drive shaft of a printing machine for attaching a printing plate including a cylindrical plate main body and a printing portion formed on a part of an outer peripheral portion of the cylindrical plate main body, comprising:

a plate cylinder configured to be fixedly mounted on an outer periphery of the plate drive shaft and having a cylindrical plate attaching surface to which the printing plate is to be attached from a tip end side of the plate drive shaft; and a plurality of plate securing members arranged at the plate attaching surface so as to extend in a rectangular shape along an axial direction of the plate cylinder, to be movable in both radially outward and inward directions of the plate cylinder, and configured to come into contact with the printing plate attached to the plate attaching surface to increase a diameter of the printing plate to closely attach the printing plate to the plate attaching surface; wherein the plate attaching surface includes a portion not including the plurality of plate securing members, and the portion not including the plurality of plate securing members is configured to not be movable in both the radially outward and inward directions of the plate cylinder.

2. The plate attachment device as recited in claim 1, wherein at least a part of the plate securing member includes a contact surface which comes into contact with an inner peripheral portion of the printing plate, the contact surface being formed to have a curved shape having a same curvature as an outer peripheral surface of the plate cylinder.

3. The plate attachment device as recited in claim 2, wherein the contact surface of the plate securing member is configured to be positioned at a same height as the plate attaching surface of the plate cylinder when the printing plate is in close contact with the plate attaching surface.

4. The plate attachment device as recited in claim 1, wherein the plurality of plate securing members are arranged at symmetrical positions on a circumference of circle of the plate cylinder.

5. The plate attachment device as recited in claim 1, wherein the printing plate is provided with an engaging portion inwardly protruding from an inner periphery of the plate main body and extending in an axial direction of the plate main body, and wherein the plate cylinder is provided, at an outer peripheral surface thereof, with a circumferential positioning groove into which the engaging portion of the printing plate is fitted from the tip end side of the plate drive shaft.

6. The plate attachment device as recited in claim 1, further comprising a gap provided between the plate cylinder and the printing plate when the plurality of plate securing members are moved radially inward of the plate cylinder.

7. A method of attaching and detaching a printing plate having a printing portion provided at a part of an outer peripheral portion of a cylindrical plate main body to and from a plate attachment device fixed to a plate drive shaft of a printing machine, comprising the steps of:

moving a plurality of plate securing members radially inward of a plate cylinder, wherein the plurality of plate securing members are each arranged to extend in a rectangular shape along an axial direction of the plate cylinder and movable in both radially outward and inward directions of the plate cylinder fixed to an outer periphery of the plate drive shaft and having a cylindrical plate attaching surface;

fitting the printing plate onto the plate cylinder from a tip end side of the plate drive shaft in a state in which a circumferential length of the outer periphery of the plate cylinder is set to be shorter than a circumferential length of the inner periphery of the printing plate;

mounting the printing plate onto the plate cylinder so that the plate attaching surface which is an outer periphery of the plate cylinder and an inner peripheral surface of the printing plate come into close contact with each other by moving the plate securing members radially outward of the plate cylinder;

making a gap between the plate cylinder and the printing plate by moving the plate securing members radially inward of the plate cylinder from a state in which the plate attaching surface which is an outer periphery of the plate cylinder and the inner peripheral surface of the printing plate are in close contact with each other; and detaching the printing plate from the plate cylinder by pulling out the printing plate fitted on the plate cylinder in a direction toward a tip end of the plate drive shaft; wherein the plate attaching surface includes a portion not including the plurality of plate securing members, and the portion not including the plurality of plate securing members is configured to not be movable in both the radially outward and inward directions of the plate cylinder.

8. The printing plate attachment and detachment method as recited in claim 7, wherein at least a part of the plate securing member formed into a curved surface shape having a same curvature as an outer peripheral surface of the plate cylinder is brought into contact with an inner peripheral portion of the printing plate.

9. The printing plate attachment and detachment method as recited in claim 8, wherein the surface of the plate securing member is positioned at the same height as the plate attaching surface of the plate cylinder when the printing plate is closely fixed to the plate attaching surface of the printing plate.

10. The printing plate attachment and detachment method as recited in claim 7, wherein the plurality of plate securing members are arranged at symmetrical positions on a circumference of circle of the plate cylinder.

11. The printing plate attachment and detachment method as recited in claim 7, wherein an engaging portion of the printing plate protruding inwardly from the inner periphery of the plate main body and extending in a radial direction of the plate main body is fitted into a circumferential positioning groove formed in the outer periphery of the plate cylinder from the tip end side of the plate drive shaft.

* * * * *